US005390862A

United States Patent [19]

Eglin

[11] Patent Number: 5,390,862

[45] Date of Patent: Feb. 21, 1995

[54] APPARATUS FOR CHIPPING AND GRINDING TREE LIMBS

[75] Inventor: John H. Eglin, Polk, Ohio

[73] Assignee: 7/7/77 Incorporated, West Carrollton, Ohio

[21] Appl. No.: 93,662

[22] Filed: Jul. 20, 1993

Related U.S. Application Data

[63] Continuation of Ser. No. 897,493, Jun. 12, 1992, abandoned.

[51] Int. Cl.[6] ..... B02C 19/12

[52] U.S. Cl. ..... 241/29; 241/101.7; 241/152.2; 241/241

[58] Field of Search ..... 241/29, 28, 101.7, 152.2, 241/189.1, 190, 240, 241, 242, 243, 154, 13, 158, 160

[56] References Cited

U.S. PATENT DOCUMENTS

| | | | |
|---|---|---|---|
| 64,834 | 5/1867 | Bruce | 241/154 |
| 312,342 | 2/1885 | Duryea | 241/160 X |
| 1,143,106 | 6/1915 | Davies et al. | 241/154 X |
| 1,776,593 | 9/1930 | Meyer | 241/152.2 X |
| 1,883,876 | 10/1932 | Brown | 241/28 |
| 1,967,313 | 7/1934 | Holland-Letz | 241/152.2 X |
| 1,969,420 | 8/1934 | Mills | 241/160 X |
| 1,996,177 | 4/1935 | Stevenson | 241/152.2 X |
| 2,954,937 | 10/1960 | Freeman | 241/158 X |
| 3,195,592 | 7/1965 | Hall | 241/189.1 X |
| 3,659,794 | 5/1972 | Hemesath | 241/189.1 |
| 3,881,662 | 5/1975 | Gunnarsson | 241/292.1 X |
| 3,926,378 | 12/1975 | Ryan | 241/154 |
| 4,087,051 | 5/1978 | Moeller | 241/190 X |
| 4,214,713 | 7/1980 | Wright | 241/101.7 X |
| 4,318,512 | 3/1982 | Jacobson et al. | 241/189.1 X |
| 4,358,995 | 11/1982 | Ballo et al. | 241/242 X |
| 4,717,081 | 1/1988 | Hamilton | 241/152.2 X |
| 4,767,067 | 8/1988 | Bruer et al. | 241/158 X |
| 4,773,601 | 9/1988 | Urich et al. | 241/101.7 |
| 4,816,075 | 3/1989 | Gruenewald | 241/160 X |
| 4,824,034 | 4/1989 | Baker | 241/101.7 X |
| 4,834,302 | 5/1989 | Baker | 241/101.7 X |
| 4,951,882 | 8/1990 | Ober | 241/101.7 X |
| 5,005,620 | 4/1991 | Morey | 241/101.7 X |
| 5,018,672 | 5/1991 | Peck et al. | 241/101.7 X |
| 5,062,575 | 11/1991 | Barnabie et al. | 241/190 X |
| 5,148,844 | 9/1992 | Robison | 241/101.7 X |
| 5,154,363 | 10/1992 | Eddy | 241/190 X |

FOREIGN PATENT DOCUMENTS

| | | | |
|---|---|---|---|
| 724239 | 4/1932 | France | 241/160 |
| 2280311 | 2/1976 | France | 241/243 |
| 278405 | 11/1970 | U.S.S.R. | 241/152 A |
| 899000 | 1/1982 | U.S.S.R. | 241/154 |
| 1020064 | 5/1983 | U.S.S.R. | 241/154 |
| 1505578 | 9/1989 | U.S.S.R. | 241/160 |

*Primary Examiner*—Rinaldi I. Rada
*Assistant Examiner*—Carl F. Dexter
*Attorney, Agent, or Firm*—Cushman, Darby & Cushman

[57] ABSTRACT

An apparatus for reducing tree limbs, branches and the like to fine particles is provided which includes a frame assembly supported by wheels and having a hitch at one end thereof; a first housing affixed to the frame assembly having an infeed opening, an outfeed opening and cavity therein; a member for chipping the limbs rotatably disposed within the cavity; a feed chute affixed to the infeed opening and communicating with the cavity for guiding the limbs into the chipping means; an element for rotating the chipping member; and an outfeed chute affixed to the outfeed opening for guiding chipped particles out of the cavity. The apparatus further includes a second housing affixed to the frame assembly having an interior portion, an inlet opening and an exit opening; the outfeed chute being affixed to the inlet opening; a member for grinding rotatably disposed within the interior portion for grinding the chipped particles exiting the chipping member; an element for rotating the grinding member; and a discharge chute affixed to the exit opening for discharging ground particles exiting the second housing.

19 Claims, 4 Drawing Sheets

APPARATUS FOR CHIPPING AND GRINDING TREE LIMBS

This is a continuation of application Ser. No. 07/897,493, filed on Jun. 12, 1992, which was abandoned upon the filing hereof.

BACKGROUND OF THE INVENTION

The present invention relates generally to an apparatus for reducing, the size of tree limbs for disposal, mulching or composting, and more particularly to a combination of a wood chipper and grinder apparatus arranged on a single frame which work in unison to greatly reduce the size of the tree limbs, branches or the like. A separate chipper is provided to chip large tree limbs up to 6 inches in diameter. The chips are sent from the chipper into a grinder to further reduce the size of the wood chips. The fine wood particles are then discharged from the apparatus for disposal, mulching or composite. The apparatus is mobile and is particularly adapted for use in tree servicing.

Conventional wood chippers such as disclosed in U.S. Pat. No. 5,005,620 have been developed to reduce trees, limbs and branches to wood chips. Such chippers are typically used by municipalities and tree services. Chipping eliminates environmental concerns associated with burning since the chips may be used as mulch, or for compost. These chippers, however, only reduce the tree limbs to long strings. Such large chips do not facilitate rapid decay when disposed and consume much needed landfill space.

Other chipper devices have been developed to further reduce wood chips. For example, U.S. Pat. No. 4,824,034 discloses a wood chipper-shredder device. However, to achieve a desired particle size, a screen must be employed which retains material not capable of passing therethrough for further chipping. The use of such screening is undesirable since clogging of the device may occur. Also, additional time is required for further reducing the material to enable it to pass through the screen.

Accordingly, to overcome the inadequacies of the prior art, there exists a need to provide an apparatus for reducing large tree limbs to fine wood particles by combining a separate chipper and grinder in a manner which permits these units to work in unison.

SUMMARY OF THE INVENTION

It is an object of the invention to provide a chipper-grinder apparatus to fulfill the need referred to above. In accordance with the principles of the present invention, this objective is obtained by providing an apparatus for reducing tree limbs, branches and the like to fine particles including a frame assembly supported by wheels and having a hitch at one end thereof; a first housing affixed to the frame assembly having an infeed opening, an outfeed opening and cavity therein; a member for chipping the limbs rotatably disposed within the cavity; a feed chute affixed to the infeed opening and communicating with the cavity for guiding the limbs into the chipping means; an element for rotating the chipping member; and an outfeed chute affixed to the outfeed opening for guiding chipped particles out of the cavity. The apparatus further includes a second housing affixed to the frame assembly having an interior portion, an inlet opening and an exit opening; the outfeed chute being affixed to the inlet opening; a member for grinding rotatably disposed within the interior portion for grinding the chipped particles exiting the chipping member; an element for rotating the grinding member; and a discharge chute affixed to the exit opening for discharging ground particles exiting the second housing.

Other objects, features and characteristics of the present invention, as well as the methods of operation and functions of the related elements of the structure, and the combination of the parts and economics of manufacture, will become more apparent upon consideration of the following detailed description and appended claims with reference to the accompanying drawings, all of which form a part of this specification.

DETAILED DESCRIPTION OF THE PREFERRED EMBODIMENT

Figure 1:
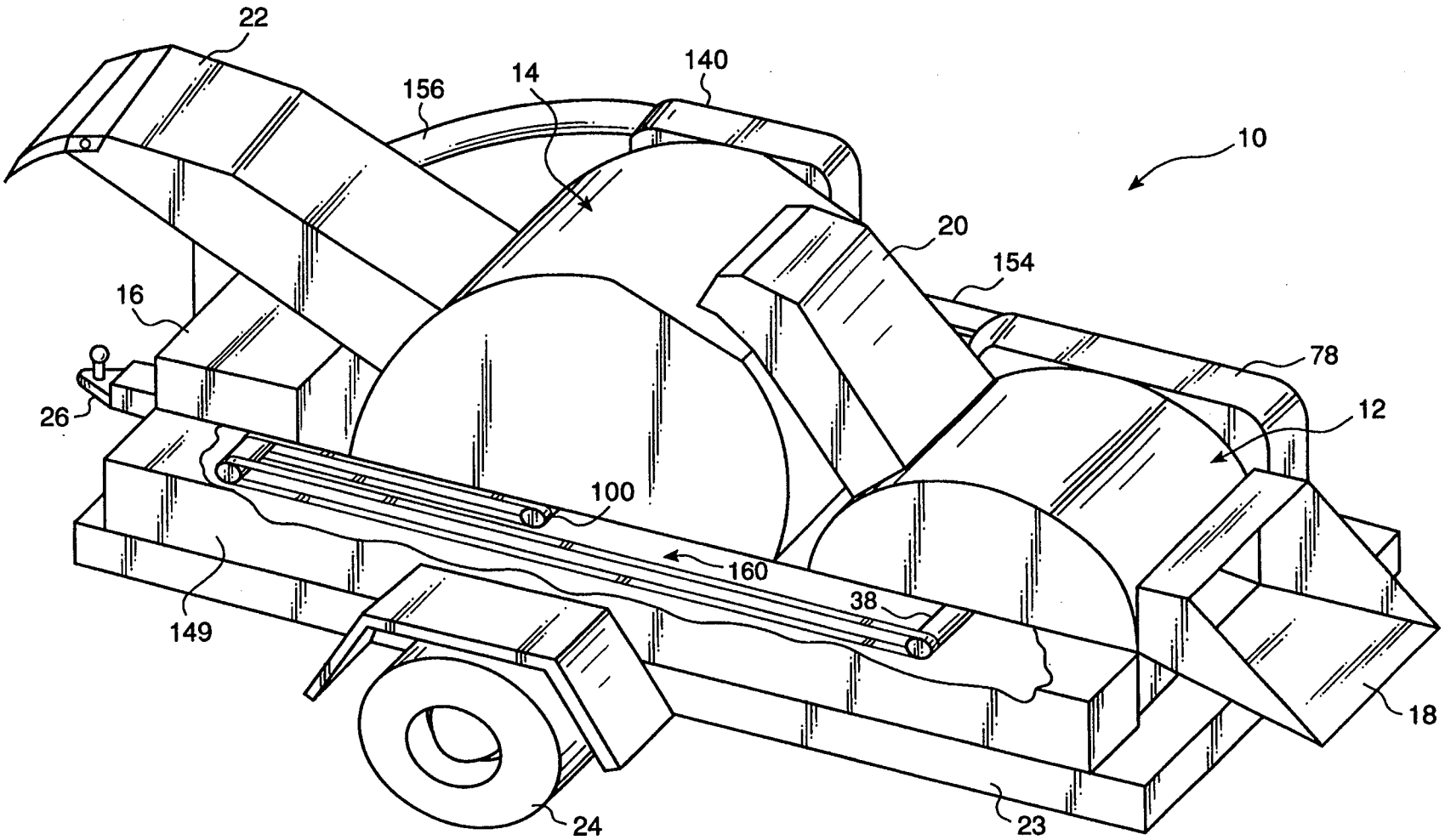
FIG. 1 is a perspective view of a portable wood chipper-grinder apparatus embodying the principles of the present invention.

Referring to the drawings, an apparatus is shown for chipping and grinding tree limbs, branches and the like, generally indicated at 10, which embodies the principles of the present invention.

The apparatus 10 includes a chipping device, generally indicated at 12, a grinding device, generally indicated at 14, a power source 16 such as an internal combustion engine, an infeed chute 18, an intermediate chute 20, a discharge chute 22 and a frame assembly 23 supported by a pair of wheels 24 and having a conventional hitch 26.

Figure 2:
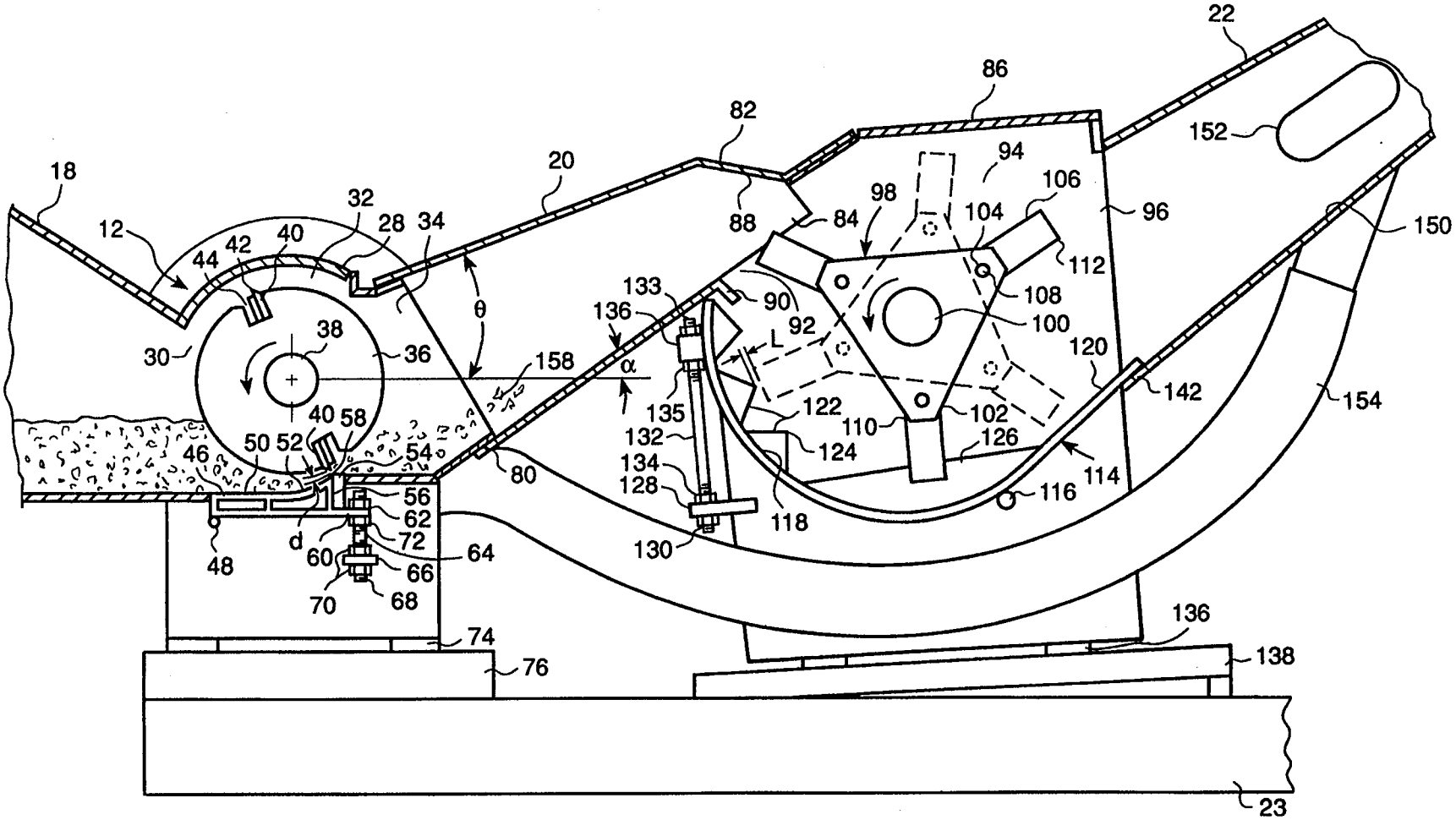
FIG. 2 is a partial cross-sectional front view of the chipper-grinder apparatus of the present invention shown with the motor and a portion of the frame assembly removed for clarity.
Figure 3:
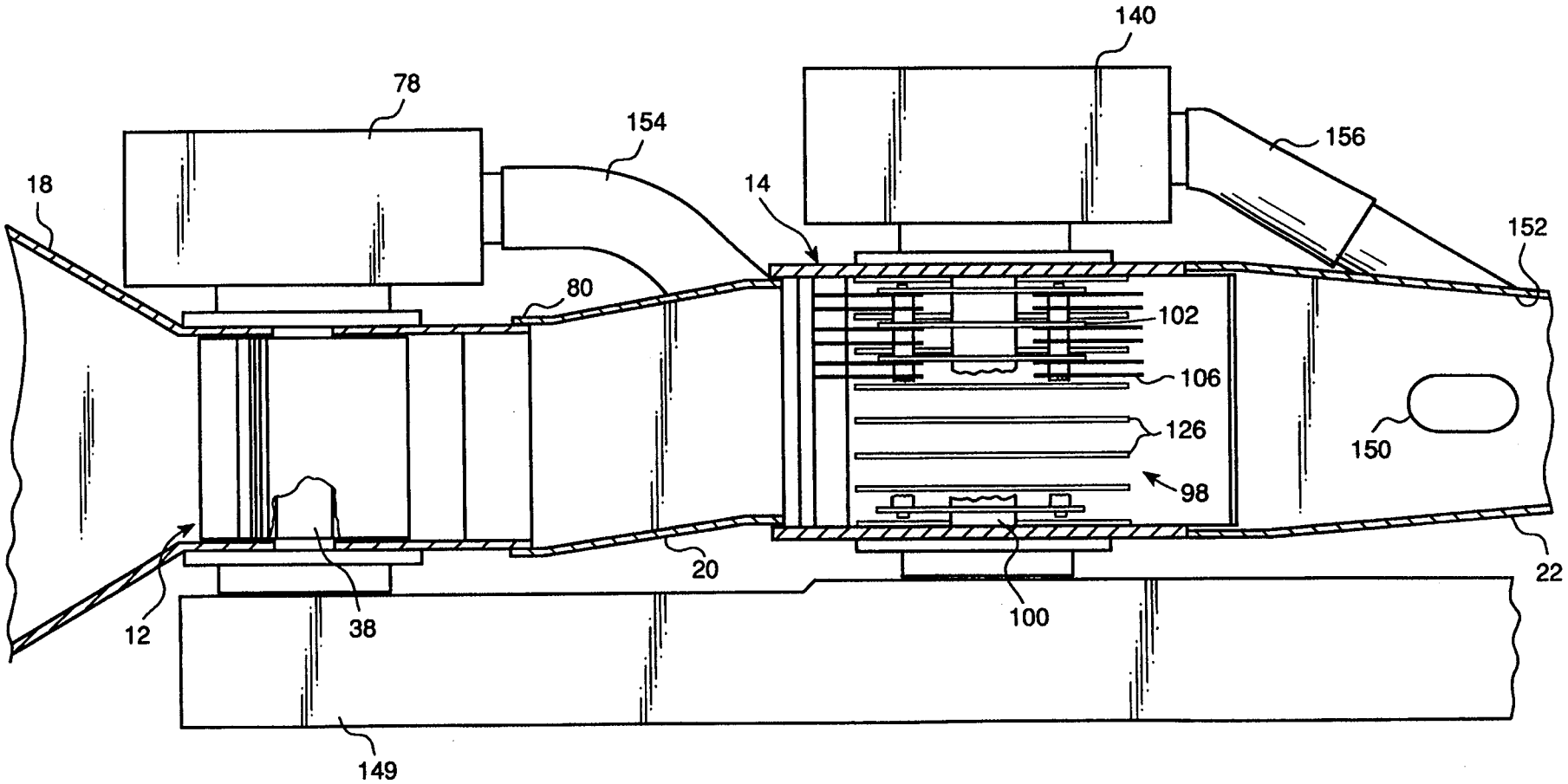
FIG. 3 is a partial cross-sectional top view of the chipper-grinder apparatus of the present invention shown with a the motor and a portion of the frame assembly removed for clarity.
Figure 4:
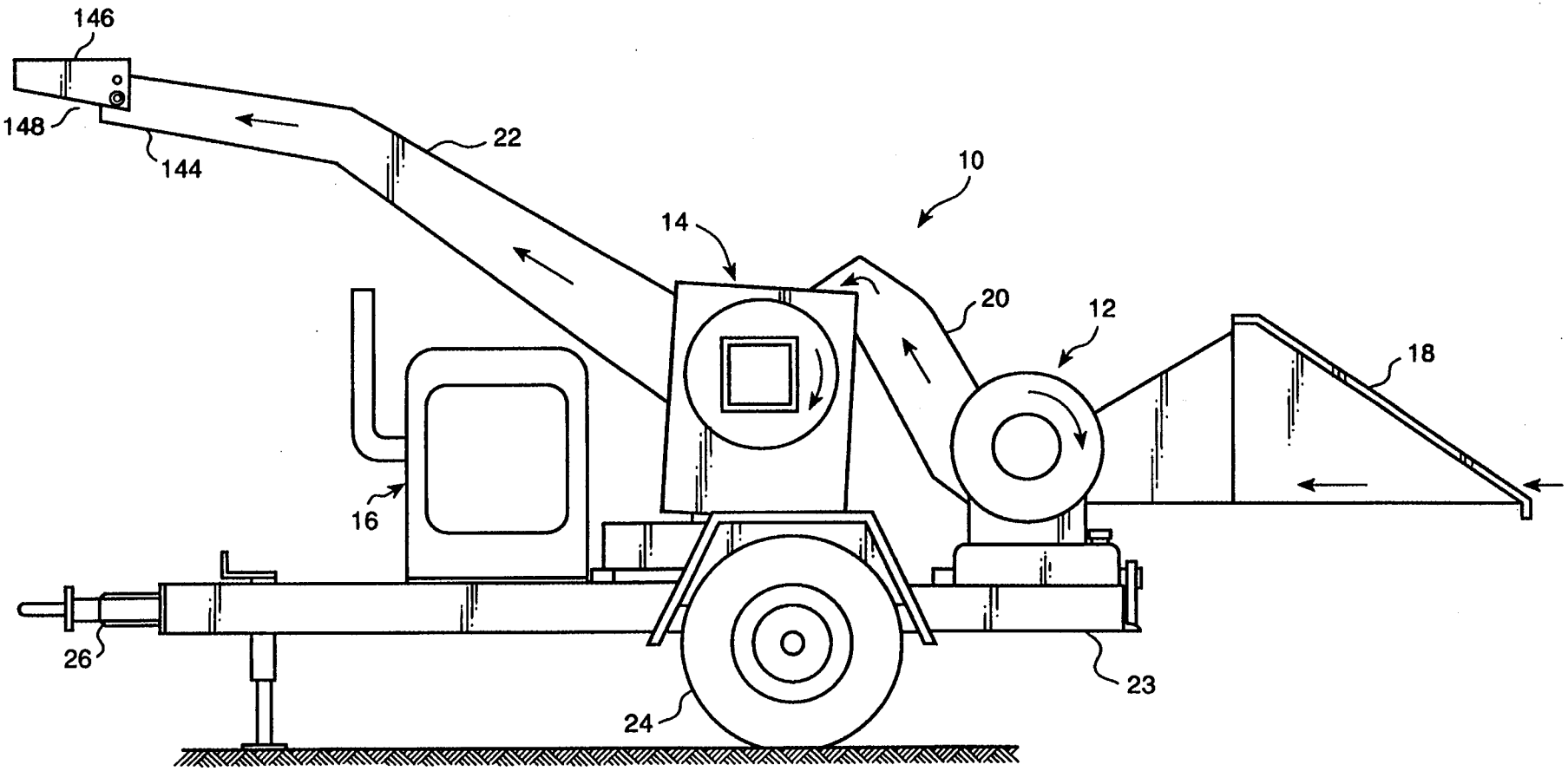
FIG. 4 is a schematic front view of a chipper-grinder apparatus mounted on a trailer shown with the blower assemblies and drive belts removed for clarity.

The chipping device 12 may be constructed in any desired configuration. However, the currently preferred configuration of the chipping device is shown in FIGS. 2 and 3. Thus, the chipping device 12 includes a housing assembly 28 with an infeed opening 30, an interior cavity 32 and an outfeed opening 34. Centrally rotatably mounted within the cavity is a rotor drum 36.

The infeed chute 18 is generally of conventional structure and is affixed to the infeed opening 30 of the housing assembly by welding or the like. The infeed chute 18 guides the tree limbs to be chipped into the interior cavity 32 of the housing assembly.

The intermediate chute 20 is affixed, by welding or the like, to the outfeed opening 34 of the housing assembly for directing wood chips out of the interior portion of the housing assembly.

The rotor drum 36 includes a shaft 38 coupled to the power source 16, which provides rotation of the rotor drum 36 As shown in FIGS. 2 and 3, the rotor drum 36 includes a plurality of chipping knives 40, each having a sharpened edge 42. The chipping knives 40 are removably mounted in slots 44 disposed in the outer peripheral surface of the rotor drum 36. The preferred embodiment includes two uniformly spaced chipping knives 40.

Of course, more chipping knives may be employed, when it is desired to increase the feed of material into the chipping device 12.

The chipping device 12 includes a feed plate 46 pivotly mounted to the housing assembly 28 by pin 48. The feed plate 46 defines a lower boundary surface of the interior cavity 32. The feed plate has a planar surface 50 which abuts a lower interior surface of the infeed chute 18. The planar surface 50 smoothly merges into a curved surface 52 near the central portion of the interior cavity 32.

A bed knife 54 is affixed to the feed plate 46 at end 56. The bed knife 54 includes a sharpened edge 58 which extends past end 56 of the feed plate into the interior cavity 32, so as to define a clearance distance (d) between the bed knife 54 and chipping knives 40.

The bed knife 54 is supported by a cantilever portion 60 of the feed plate. End 62 of the cantilever portion 60 includes a bore therethrough. A threaded rod 64 is inserted into the bore. The housing assembly 28 includes a mounting member 66 also having a bore which is axially aligned with the bore of the feed plate 46. End 68 of the threaded rod 64 is inserted into the bore of the mounting member 66 and locked thereto with nuts 70. The clearance distance (d) may be adjusted by pivoting the feed plate 46 to a desired location and then securing the feed plate to the housing assembly 28 by locking nuts 72 against the cantilever portion 60 of the feed plate 46.

The housing assembly 28 is supported by vibration dampers 74 which are mounted to base member 76. The base member 76 is mounted to the frame assembly 23.

In the preferred embodiment as shown in FIG. 3, chipping device 12 includes a conventional blower 78 coupled to, and driven by, shaft 38, the function of which will be described below.

The intermediate chute 20, as shown in FIG. 2, has a tunnel-like construction. End 80 is affixed to the housing assembly 28, with the body of the intermediate chute 20 tapering to a narrow end portion 82. The narrow end portion 82 has a discharge opening 84, which is affixed at one end to the grinder housing 86. The intermediate chute 20 includes deflectors 88 and 90 to direct wood chips into the grinder housing 86. The intermediate chute is affixed at angles $\Theta=20°$ and $\alpha=37°$ between the chipping device 12 and grinding device 14 (FIG. 2) so that wood chips exiting the chipping device 12 are properly delivered to the grinding device 14 without clogging.

While the grinding device 14 may be configured in many configurations, the preferred configuration of the grinding device is shown in FIGS. 2 and 3. Thus, the grinding device 14 includes a grinder housing 86 having an inlet opening 92, an interior portion 94 and a discharge opening 96. The intermediate chute 20 is affixed to the inlet opening 92 of the grinder housing by welding or the like.

Centrally mounted in the interior portion 94 is a rotor plate assembly, generally indicated at 98. As shown in FIG. 3, the rotor plate assembly 98 includes a shaft 100 extending the entire width of the interior portion 94 and being operatively coupled to the power source 16 for providing rotation of the rotor plate assembly 98. A plurality of rotor plates 102 are uniformly mounted on shaft 100. In the illustrative embodiment, each rotor plate 102 is of generally triangular shape and has three bores 104 therethrough.

The rotor plate assembly 98 further includes a plurality of hammers 106 pivotably mounted to peripheral ends thereof. The rotor plates are oriented so that the three bores 104 of each plate are aligned with the bores 104 of an adjacent rotor plate. Shafts 108 are disposed in the bores to fixedly couple the rotor plates 102 together.

Each hammer 106 is an elongated bar having a proximal end 110 and distal end 112. The proximal end 110 of each hammer is mounted on one of the shafts 108, and the distal ends 112 of each hammer extend radially outwardly from the rotor plates 102. The distal end 112 of each hammer is shown being generally of flat construction. However, the distal end may include a crescent-shaped cutout defining a hook having a point for grabbing and tearing wood particles.

In the preferred embodiment, two hammers 106 are adjacently mounted on each of the three shafts 108 and are disposed between successive rotor plates 102. However, either more or fewer hammers may be used so long as the balance of the rotor plate assembly 98 is maintained.

A grate assembly, generally indicated at 114, is pivotly coupled to the grinder housing 86 by pin 116, defining a lower boundary of the interior space 94. The grate assembly 114 has a constant-radiused inner peripheral portion 118 which smoothly merges into a planar portion 120 near the discharge opening 96. Pin 116 is coupled to the grinder housing so as to be in rolling contact with the outer peripheral surface of the grate assembly 114, the function of which will become apparent below.

Rigidly affixed to the constant-radiused portion 118 of the grate assembly are a plurality of cutting members 122. In the illustrative embodiment, three cutting members are shown. Each cutting member 122 includes a cutting edge 124, which protrudes into the interior space of the grinder housing defining a clearance distance (L) between the distal ends 112 of the hammers 106 and the cutting edges 124. The cutting members 122 are affixed to the grate assembly so that the cutting edges 124 are disposed at a constant distance from the center of shaft 100.

As shown in FIG. 2, rigidly fixed to the lower interior surface of the grate assembly 114 are a plurality of uniformly spaced grate plates 126. The grate plates 126 are arranged so that one rotor plate 102 is disposed between successive grate plates, with pairs of hammers passing between successive grate plates 126. In the illustrative embodiment, eight grate plates 126 are utilized along with seven rotor plates 102, one rotor plate being disposed between adjacent grate plates (FIG. 3).

An outer peripheral surface of the grate assembly 114 includes a coupling member 128. The coupling member 128 has a bore therethrough for accepting end 130 of threaded rod 132. The threaded rod 132 is secured to the coupling member by nuts 134. The grinder housing 86 includes a projection 136 having a bore therethrough for accepting end 133 of the threaded rod 132. The threaded rod 132 may be utilized to adjustably affix the grate assembly to the grinder housing by lock nuts 135. The clearance distance (L) may be adjusted by loosening nuts 135 and moving the coupling member 128 axially along the threaded rod 132. Such movement is possible since the outer periphery of the grate assembly 114 may move about pin 116. This action will move the cutting edges 124 either closer to, or further from, the distal ends 112 of the hammers 106, thus varying the grinding capability of the grinding device 14.

The grinder housing 86 is supported by vibration dampers 136 which are secured to base 138. The base 138 is mounted to the frame assembly 23.

In the illustrative embodiment, as shown in FIG. 3, the grinding device 14 includes a conventional blower 140 coupled to, and driven by, shaft 100, the function of which will become apparent below.

A discharge chute 22 is affixed to the discharge opening 96 of the grinder housing at proximal end 142 by welding or the like. The discharge chute gradually tapers in cross-section from the proximal end 142 to distal end 144. Pivotly coupled to the distal end 142 is deflector 146 for directing discharged particles through opening 148 into a holding bin, such as a truckbed.

The discharge chute 22 has a first opening 150 disposed in the underside thereof and a second opening 152 defined in a side thereof. Coupled to the first opening 150 is a flexible tube 154 which extends to, and is connected with, the outlet of blower 78. Coupled to the second opening 152 is a second flexible tube 156 which extends to, and is connected with, the outlet of blower 140. The function of the tubes and blowers will be apparent below.

OPERATION

The apparatus 10 is connected to a service vehicle by hitch 26 for towing to a work site. As is conventional in the art, the vehicle will typically include a storage bin for receiving fine wood particles from the discharge chute.

At the work site, the power source 16 or engine is started. A conventional belt-pulley arrangement generally indicated at 160 is employed so that rotary motion produced by the engine is imparted to both shafts 38, 100 of the rotor drum 36 and the rotor plate assembly 98. The belt-pulley arrangement 160 is enclosed in a belt guard 149. Since the blowers 78 and 140 are coupled respectively to shafts 38 and 100, the blowers are also driven by the power source 16. Of course, separate engines may be employed to separately drive the grinding device and the chipping device.

In operation, the speed of the power source 16 brings the speed of rotor drum 36 to approximately 2800 r.p.m., while the speed of the rotary plate assembly 98 is approximately between 3100 and 3200 r.p.m.

As best illustrated in FIG. 2, the rotor drum 36 and rotor plate assembly 98 rotate in the direction of the arrows, so that both the chipping knives 40 and hammers 106 move downwardly and forwardly in the area of the infeed opening 30 of the chipping device 12 and inlet opening 92 of the grinding device 14, respectively.

The tree limb to be reduced is introduced into the infeed chute 18 to the rotor drum 36. The chipping knives 40 move downwardly through and along the material, forcing the material to the bed knife 54. Both the chipping knives 40 and bed knife 54 chip the tree limb. Since the cut chips 158 travel with the rotor drum 36, the chips are expelled radially outward due to the centrifugal force of the rotor drum. The chips 158 are propelled through the intermediate chute 20 by centrifugal force. Blowers are not needed to move the chips through the intermediate chute 20.

As shown in FIG. 2, the intermediate chute 20 is disposed at specific angles $\Theta$ and $\alpha$ with respect to a centerline passing through shaft 38, while the grinding device 14 is mounted at an angle of approximately 5 degrees in relation to the frame assembly 23, shifted in the direction of the chipping device 12. This orientation enables chips 158 exiting the chipping device 12 to the delivered to the grinding device 14 efficiently and without plugging, thereby permitting the chipping and grinding devices to work in unison.

The chips 158 are deflected by the intermediate chute 20 and pulled down into the grinding device 14 by the hammers 106. The centrifugal force generated by the rotor plate assembly 98 forces the chips along the periphery of grate plate assembly 114. The hammers 106 pull the chips across the cutting edges 124, where the chips are further reduced in size. The hammers 106 move the reduced chips through the grate plates 126 to grind the chips. The chips are then discharged through the discharge chute 22.

To aid in moving the ground particles up and out of the discharge chute 22, air from blowers 78 and 140 is delivered to the discharge chute 22 via the flexible tubes 154, 156, In the illustrative embodiment, two blowers are used. However, it can be appreciated that other chip moving devices may be employed. The finely ground particles are discharged into the storage bin for removal from the worksite.

It can be seen that the apparatus 10 of the present invention provides an effective means of reducing tree limbs or the like to finely ground particles. The provision of a separate chipping device and a separate grinding device which work in unison provides an efficient method of reducing tree limbs. The apparatus does not require screening to achieve finely ground particles. Therefore, clogging of the apparatus is minimized, and the speed of reducing the limbs is increased.

While the invention has been described in connection with what is presently considered to be the most practical and preferred embodiment, it is understood that the invention is not limited to the disclosed embodiment but, on the contrary, is intended to cover various modifications and equivalent arrangements included within the spirit and scope of the appended claims.

What is claimed is:

1. An apparatus for reducing tree limbs and branches to fine particles comprising:

a mobile frame assembly;

a first housing affixed to said frame assembly having an infeed opening, an outfeed opening and cavity therein;

means for chipping the limbs disposed within said cavity, said chipping means including a rotor drum centrally disposed within said cavity;

a substantially horizontally disposed feed chute affixed to said infeed opening and communicating with said cavity for substantially horizontally guiding the limbs to said chipping means;

means for rotating said rotor drum;

an outfeed chute affixed to said outfeed opening for guiding chipped particles out of said cavity;

a second housing affixed to said frame assembly and disposed substantially horizontally adjacent to said first housing, said second housing having an interior portion, an inlet opening and an exit opening, said outfeed chute affixed to said inlet opening;

means for grinding disposed within said interior portion for grinding the chipped particles exiting said chipping means, said grinding means including a rotor assembly centrally rotatably mounted within said interior portion;

means for rotating said rotor assembly; and a discharge chute affixed to said exit opening for discharging ground particles exiting said second housing, said chipping means comprising:

a plurality of chipping knives disposed on an outer peripheral surface of said rotor drums each chipping knife of said plurality of chipping knives extending generally an entire axial length of said rotor drum;

a feed plate mounted to a lower surface of said first housing; and a bed knife affixed to an end of said feed plate extending into said cavity so as to define a clearance distance between said plurality of chipping knives and said bed knife, said plurality of chipping knives and said bed knife being constructed and arranged to engage a tree limb so as to move the limb generally horizontally into the cavity to be chipped therein, said outfeed chute extending generally upwardly between said outfeed opening of the first housing and said inlet opening of the second housing so as to direct the chipped particles generally upwardly from said first housing into said second housing without clogging.

2. An apparatus as claimed in claim 1, further comprising at least one blowing element, said at least one blowing element being coupled to at least one of said means for rotating said rotor drum and said means for rotating said rotor assembly to provide a discharge of air from said at least one blowing element, said at least one blowing element being coupled to said discharge chute for directing air to move ground particles through said discharge chute.

3. An apparatus as claimed in claim 2, wherein first and second blowing elements are provided, the first blowing element being coupled to said means for rotating said rotor drum, the second blowing element being coupled to said means for rotating said rotor assembly, the first blowing element supplying air to said outfeed chute, the second blowing element supplying air to said discharge chute.

4. An apparatus as claimed in claim 1, wherein said means for rotating said rotor drum and said means for rotating said rotor assembly comprises at least one engine operatively coupled to said rotor drum and said rotor assembly to provide rotation thereof.

5. An apparatus as claimed in claim 1, wherein said rotor assembly comprises:

a plurality of rotor plates uniformly distributed along a shaft that defines the axis of rotation of said rotor assembly, and a plurality of hammers pivotly mounted to each of said rotor plates at an outer peripheral surface thereof, and wherein said grinding means further includes:

a grate assembly pivotly mounted within said interior portion of said second housing, said grate assembly including a plurality of grate plates uniformly fixedly mounted on a lower surface of said grate assembly, said rotor plates being disposed between successive grate plates, a plurality of cutting edges affixed to a surface of said grate assembly adjacent said grate plates so as to form a clearance distance between said hammers and said cutting edges; and means for adjusting said clearance distance between tips of said hammers and said cutting edges, said hammers pulling chipped particles exiting said chipping means past said cutting edges and between said grate plates so as to further reduce the size of the chipped particles, the reduced chipped particles being moved up said discharge chute and discharged.

6. An apparatus as claimed in claim 5, wherein said chipping means further comprises a means for adjusting said clearance distance between said plurality of chipping knives and said bed knife which includes a threaded screw having one end affixed to said first housing and the other end adjustably affixed to said feed plate, whereby said feed plate is pivotable with respect to said first housing enabling said bed knife to move relative to said chipping knives, said feed plate being fixed in a predetermined position by locking said feed plate to said threaded screw with a nut.

7. An apparatus as claimed in claim 5, wherein said means for adjusting said clearance between said tips of said hammers and said cutting edges includes a threaded rod member affixed at one end thereof to an exterior of said second housing, a second end of said threaded rod being adjustably coupled to an exterior surface of said grate assembly, whereby said grate assembly is pivotable with respect to said second housing enabling said cutting edges to move relative to said hammer tips, said grate assembly being fixed in a selected position with respect to said second housing by locking said grate assembly to said threaded rod with a nut.

8. An apparatus as claimed in claim 5, wherein at least three said cutting edges are provided.

9. An apparatus as claimed in claim 5, wherein three said hammers are mounted to each said rotor plate.

10. An apparatus as claimed in claim 1, wherein two said chipping knives are provided.

11. An apparatus as claimed in claim 1, wherein said frame assembly is supported by wheels, said frame assembly having a hitch at one end thereof enabling said apparatus to be mobile.

12. An apparatus as claimed in claim 1, wherein said chipping means further includes means for adjusting said clearance distance, the limbs being pulled by said knives across said feed plate and into said bed knife and chipped.

13. An apparatus for reducing tree limbs and branches to fine particles comprising:

a first housing assembly having an infeed opening, an outfeed opening and cavity therein;

means for chipping the limbs disposed within said cavity, said chipping means including a rotor drum centrally disposed within said cavity;

a substantially horizontally disposed feed chute affixed to said infeed opening and communicating with said cavity for substantially horizontally guiding the limbs to said chipping means;

means for rotating said rotor drum;

an outfeed chute affixed to said outfeed opening for guiding chipped particles out of said cavity;

a second housing disposed substantially horizontally adjacent said first housing, said second housing having an interior portion, an inlet opening and an exit opening, said outfeed chute affixed to said inlet opening;

means for grinding disposed within said interior portion for grinding the chipped particles exiting said chipping means, said grinding means including a rotor assembly centrally rotatably mounted within said interior portion;

means for rotating said rotor assembly; and a discharge chute affixed to said exit opening for discharging ground particles exiting said second housing, said chipping means comprising:

a plurality of knives disposed on an outer peripheral surface of said rotor drums each knife of said plurality of knives extending generally an entire axial length of said rotor drum;

a feed plate mounted to a lower surface of said first housing; and a bed knife affixed to an end of said feed plate extending into said cavity so as to define a clearance distance between said plurality of knives and said bed knife, said plurality of knives and said bed knife being constructed and arranged to engage a tree limb so as to move the limb generally horizontally into the cavity to be chipped therein, said outfeed chute extending generally upwardly between said outfeed opening of the first housing and said inlet opening of the second housing so as to direct the chipped particles generally upwardly from said first housing into said second housing without clogging.

14. An apparatus as claimed in claim 13, further comprising a frame assembly, said first and said second housings being mounted to said frame assembly.

15. An apparatus as claimed in claim 14, wherein said frame assembly is supported by wheels, said frame assembly having a hitch at one end thereof enabling said apparatus to be mobile.

16. A method for reducing tree limbs and branches to fine particles utilizing an apparatus having an infeed chute, a chipping device including a rotor drum and a plurality of rotatable chipping knives disposed on an outer peripheral surface of said rotor drum with each chipping knife of said plurality of chipping knives extending generally an entire axial length of said rotor drum and at least one stationary bed knife, a grinding device for reducing the chipped particles, an outfeed chute extending generally upwardly between said chipping device and said grinding device and connecting said chipping device to said grinding device, and a discharge chute coupled to the grinding device, the method comprising the steps of:

horizontally introducing the limbs into the infeed chute;

engaging the limbs with the chipping knives so as to draw the limbs substantially horizontally through the infeed chute and into the chipping device;

chipping the limbs in the chipping device by cooperation of said chipping knives and said bed knife to produce chipped particles;

sending the chipped particles generally upwardly through said outfeed chute and into the grinding device in such a manner so as to prevent clogging of the chipped particles, grinding the chipped particles in said grinding device so as to further reduce the size thereof into ground particles; and sending the ground particles through the discharge chute to be discharged from the grinding device.

17. An apparatus for reducing tree limbs and branches to fine particles comprising:

a frame assembly;

a first housing affixed to said frame assembly having an infeed opening, an outfeed opening and cavity therein; a chipping device constructed and arranged to chip limbs disposed within said cavity, said chipping device including a rotor drum centrally disposed within said cavity and a plurality of chipping knives disposed on an outer peripheral surface of said rotor drum, each chipping knife of said plurality of chipping knives extending generally an entire length of said rotor drum;

a substantially horizontally disposed feed chute affixed to said infeed opening and communicating with said cavity for substantially horizontally guiding the limbs to said chipping device and into said cavity to be chipped therein;

an outfeed chute affixed to said outfeed opening for guiding chipped particles out of said cavity;

a second housing affixed to said frame assembly and disposed substantially horizontally adjacent to said first housing, said second housing having an interior portion, an inlet opening and an exit opening, said outfeed chute affixed to said inlet opening;

a grinding device disposed within said interior portion of said second housing for grinding the chipped particles exiting said chipping device, said grinding device including a rotor assembly centrally rotatably mounted within said interior portion;

at least one power source constructed and arranged with respect to said rotor drum and said rotor assembly to rotate said rotor drum and said rotor assembly; and a discharge chute affixed to said exit opening for discharging ground particles exiting said second housing, said outfeed chute extending generally upwardly between said outfeed opening of the first housing and said inlet opening of the second housing so as to direct the chipped particles generally upwardly from said first housing into said second housing;

wherein said chipping device further comprises:

a feed plate mounted to a lower surface of said first housing; and a bed knife affixed to an end of said feed plate extending into said cavity so as to define a clearance distance between said plurality of chipping knives and said bed knife;

said rotor assembly comprising: a plurality of rotor plates uniformly distributed along a shaft that defines the axis of rotation of said rotor assembly, and a plurality of hammers pivotly mounted to each of said rotor plates at an outer peripheral surface thereof, and wherein said grinding device further includes:

a grate assembly pivotly mounted within said interior portion of said second housing, said grate assembly including a plurality of grate plates uniformly fixedly mounted on a lower surface of said grate assembly, said rotor plates being disposed between successive grate plates, a plurality of cutting edges affixed to a surface of said grate assembly adjacent said grate plates so as to form a clearance distance between said hammers and said cutting edges, said hammers pulling chipped particles exiting said chipping device past said cutting edges and between said grate plates so as to further reduce the size of the chipped particles, the reduced chipped particles being moved up said discharge chute and discharged.

18. The apparatus as defined in claim 17, wherein said outfeed chute includes upper and lower spaced walls, said upper wall being disposed at an angle of upward inclination of approximately 20 degrees with respect to a longitudinal axis of said feed chute, said lower wall being disposed at an angle of upward inclination of approximately 37 degrees with respect to the longitudinal axis of said feed chute.

19. The apparatus as defined in claim 17, wherein said frame assembly is supported by wheels so as to be movable.

* * * * *